United States Patent [19]

Ott

[11] Patent Number: 4,609,581

[45] Date of Patent: Sep. 2, 1986

[54] COATED ABRASIVE SHEET MATERIAL WITH LOOP ATTACHMENT MEANS

[75] Inventor: Ronald L. Ott, Lake Elmo, Minn.

[73] Assignee: Minnesota Mining and Manufacturing Company, St. Paul, Minn.

[21] Appl. No.: 723,458

[22] Filed: Apr. 15, 1985

[51] Int. Cl.[4] ..... B24D 11/02

[52] U.S. Cl. ..... 428/100; 51/358; 428/95

[58] Field of Search ..... 428/100, 95; 51/358, 51/296, 297, 298, 393, 394, 406, 407

[56] References Cited

U.S. PATENT DOCUMENTS

| | | | |
|---|---|---|---|
| 3,550,223 | 12/1970 | Erb | 24/204 |
| 4,380,092 | 4/1983 | Brothers | 428/100 |
| 4,437,269 | 3/1984 | Shaw | 51/358 |

FOREIGN PATENT DOCUMENTS 2056477A 3/1981 United Kingdom .

*Primary Examiner*—Marion C. McCamish
*Attorney, Agent, or Firm*—Donald M. Sell; James A. Smith; William L. Huebsch

[57] ABSTRACT

A coated abrasive sheet or disc material having a multiplicity of loops projecting from its side opposite the abrasive, which coated abrasive material is adapted to be held on the support surface of a pad from which project a multiplicity of hooks by releasable engagement between the loops and the hooks while the material is driven by the pad to abrade a workpiece. The backing of the coated abrasive material comprises a carrier web with a multiplicity of multifilament yarns stitched into it with portions of the yarns providing the loops.

5 Claims, 4 Drawing Figures

COATED ABRASIVE SHEET MATERIAL WITH LOOP ATTACHMENT MEANS

TECHNICAL FIELD

This application relates to coated abrasive sheet or disc material having loops projecting from its side opposite the abrasive by which the material may be attached to and driven by hooks projecting from a support surface of a pad adapted to be manually or machine driven.

BACKGROUND OF THE INVENTION

Coated abrasive sheet or disc materials are known that can be attached to a pad by releasable engagement of loops on the side of the material opposite the abrasive with hooks projecting from the support surface of the pad. Such an attachment system is much easier and simpler to use than mechanical clamps. Also it provides advantages over the use of pressure sensitive adhesive as an attachment means in that its ability to be attached to a pad is not adversely affected by the presence of loose abrasive or dirt or by environmental conditions such as abnormal moisture, heat or cold so that the abrasive sheet materials with loops can reliably be attached, removed and then reused a number of times.

While these advantages are provided by known coated abrasive sheet material with projecting attachment loops, heretofore it has been expensive to make since the backing layer that provides and anchors the loops has been entirely prepared from yarns intertwined only by weaving or knitting machines that operate at very low speeds.

DISCLOSURE OF THE INVENTION

The present invention provides a novel coated abrasive sheet or disc material with loops projecting from its side opposite the abrasive that comprises a backing layer that provides and anchors the loops including a carrier web which may be formed by much less expensive methods than weaving or knitting, and yarns stitched into the carrier web to form the loops. Such a backing layer can be produced at a high rate of speed compared to weaving or knitting so that the abrasive sheet material according to the present invention is significantly less expensive to make than coated abrasive sheet material with projecting attachment loops prepared by the prior art methods described above.

The carrier web may be of woven or nonwoven construction, with nonwoven carrier webs being preferred because of their generally lower cost. Acceptable nonwoven carrier webs may be formed by conventional techniques such as continuous filament spin bonding or wet laying, with suitable carrier webs of the former type including those sold under the trade designations Typar TM and Reemay TM by DuPont and Cerex TM by Monsanto, and suitable carrier webs of the latter type including those sold under the trade designation Confil TM by International Paper, and Manniweb TM by Manning Paper Co.

The main functions of the carrier web are to provide body and durability for the backing and to be sufficiently tough so that it can be stitched into without ripping or tearing. Preferably the carrier web is also relatively stiff and has a sufficient density to firmly anchor the stitches and provide support for the loops so that they will project outwardly from the surface of the carrier web where they can easily be engaged by the hooks on the pad. Carrier webs having a density generally in the range of ½ to 3 ounces per square yard have been found to provide these functions.

The stitches that provide the loops should be made with strong yarn, and preferably of textured, multifilament yard that forms many more potential anchoring loops than a monofilament yarn. 100 Or 150 denier 36 filament textured polyester yarns have been found very suitable for this use.

At present, the only known machine that is capable of placing the stitches in the carrier web at commercially acceptable rates is the Malimo TM type Malipol Stitch-Knitting Machine manufactured by Textima in East Germany and distributed in the United States by Chima, Inc. of Reading, Pa. It is believed, however, that new stitch knitting machines are presently under development that will also provide the needed stitching capability. Such Malipol Stitch-Knitting machines are available that can apply the stitches to carrier webs over 140 inches wide, and can apply up to 1500 stitches per minute while applying about 12 stitches per inch (which is usable for forming abrasive coated material according to the present invention), thereby producing a web speed of about 625 feet per hour which is about 5 to 10 times greater than the web speed produced by known weaving or knitting machines.

The loop height (i.e., the average height that the centers of the loops project above the carrier web) has been varied in the range of 1 to 5 millimeters on the Malipol machine and has been found to produce acceptable engagement of the loops with the hooks on the backing pad throughout that range.

Preferably the loops are formed by making 14 to 18 rows of stitches per inch measured in the cross web direction and making 10 to 40 stitches per inch along the length of the web in each row. It has been found that increasing the stitch density not only increases the number of anchoring sites for the stitches, but also causes the loops that are formed to stand more erect.

Also, the Malipol Stitching Machine can be operated in either a single guide bar mode or in a double guide bar mode. When the double guide bar mode is used, two separate threads are used for each stitch, one to form the loop and the other to lock the stitch more securely in the backing layer. The loops that are formed in the double guide bar mode have been found to stand more erect than loops formed in the single bar guide mode.

To produce abrasive sheet material that will withstand a large number of disengagements from and reengagements with the hooks on a support pad it is necessary to apply an adhesive coating (e.g., thickened or foamed latex, extruded polymer film, or hot melt adhesive) to the side of the carrier web opposite the loops. The adhesive coating will adhere the yarn to itself and to the fibers of the carrier web to restrict the loops from enlarging when they are disengaged from the hooks by tightening the stitches in the backing layer, and will provide additional adhesion between the fibers in the carrier web to restrict tearing of the carrier web when the loops are disengaged from the hooks. Such a coating should not be allowed to pass through to the side of the carrier web from which the loops project, however, or it can reduce the flexibility and erectness of the loops and thereby their ability to engage hooks on the support surface of the pad.

The carrier web with the loops stitched into it may be incorporated into coated abrasive sheet material by using the adhesive coating to bond the side of the carrier web opposite the loops to the side of the backing layer opposite the abrasive granules on conventionally made coated abrasive sheet material. Preferably, however, the abrasive is coated directly onto the adhesive coating over the surface of the carrier web opposite the loops after the adhesive coating has dried so that the adhesive coating prevents the abrasive bonding resin from penetrating the carrier web and affecting the proper presentation of the loops for engagement by hooks on a backing pad.

BRIEF DESCRIPTION OF THE DRAWING

The present invention will be further described with reference to the accompanying drawing wherein like reference numerals refer to like parts in the several views, and wherein.

DESCRIPTION OF THE PREFERRED EMBODIMENT

Figure 1:
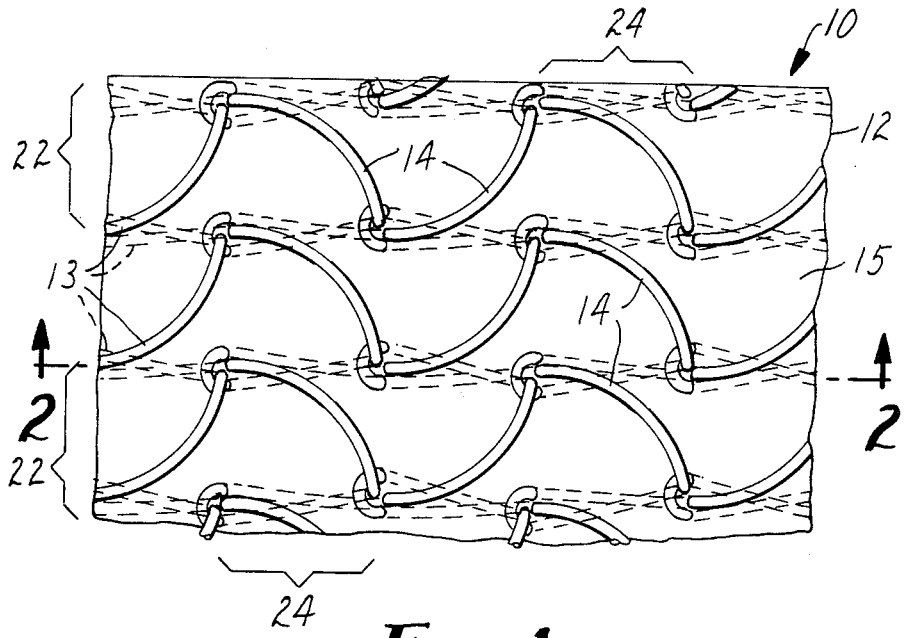
FIG. 1 is a fragmentary enlarged plan view of the back surface of a first embodiment of sheet material according to the present invention.
Figure 2:
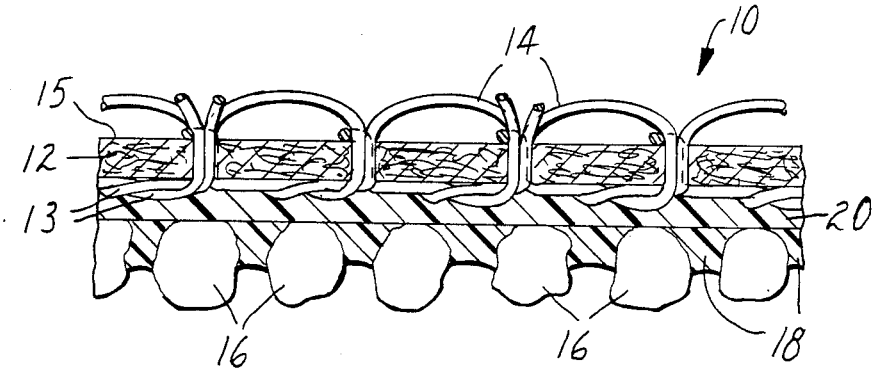
FIG. 2 is a sectional view taken approximately along line 2—2 of FIG. 1.

Referring now to the drawing there is shown in FIGS. 1 and 2 coated abrasive sheet material generally designated by the reference numeral 10.

The coated abrasive sheet material 10 comprises a nonwoven carrier web 12 having a multiplicity of multifilament threads 13 stitched into it with portions of the threads forming loops 14 projecting from a back surface 15 of the carrier web 12, and a layer of abrasive grains 16 adhered by a bonding resin 18 to a front surface of the carrier web 12 which is sealed by a coating 20 of adhesive. The coating 20 of adhesive both (1) prevents the bonding resin 18 from passing through the carrier web 12 and affecting the loops 14, and (2) locks the threads 13 forming the stitches to themselves and to the fibers of the carrier web 12 to restrict enlarging of the loops 14 by tightening of the stitches in the carrier web 12, and to restrict tearing of the stitched carrier web 12 when the loops 14 on the sheet material 10 are pulled away from hooks on a support pad with which they have been engaged.

The stitches illustrated have been made by the Malipol Stitching Machine described above operated in its single guide bar mode. As can best be seen in FIG. 1, the stitches are made in parallel rows spaced at uniform predetermined distances 22 in a cross direction on the carrier web 12 and having uniform predetermined stitch lengths 24 in the longitudinal direction of the carrier web 12, with the loops 14 being formed in alternating diagonal directions between two of the adjacent rows of stitches to form corresponding zig zag patterns of loops 14 longitudinally along the carrier web 12. Alternatively the stitches could have been made on the same machine using its "double guide bar mode" which provides additional threads to lock the threads forming the loops in the carrier web.

Figure 3:
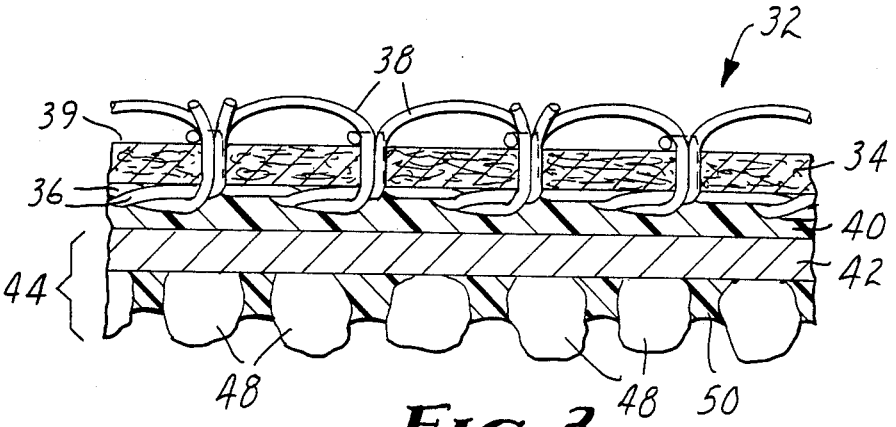
FIG. 3 is a sectional view of a second alternate embodiment of sheet material according to the present invention.

FIG. 3 shows an alternate, less preferred form of coated abrasive sheet material 32 according to the present invention which also comprises a nonwoven carrier web 34 having a multiplicity of multifilament threads 36 stitched into it with portions of the threads forming loops 38 projecting from a back surface 39 of the carrier web 34. A surface of the carrier web 34 opposite its back surface 39 is adhered by a layer of adhesive 40 to a back surface of a backing 42 on a conventional commercially available piece 44 of coated abrasive sheet or disc material (e.g., Tri-M-ite Freecut Paper Open Coat abrasive sheet material available from Minnesota Mining and Manufacturing Company, St. Paul, Minn.) which includes a layer of abrasive grains 48 adhered by a bonding layer 50 on the surface of its backing 42 opposite the carrier web 34. In addition to adhering the carrier web 34 and backing 42 together, the layer of adhesive 40 also locks the threads 36 forming the stitches to themselves and to the fibers of the carrier web 12 to restrict enlarging of the loops 38 by tightening of the stitches in the carrier web 34, and to restrict tearing of the stitched carrier web 34 when the loops on the sheet material 10 are pulled away from the hooks on a support pad with which they have been engaged.

Figure 4:
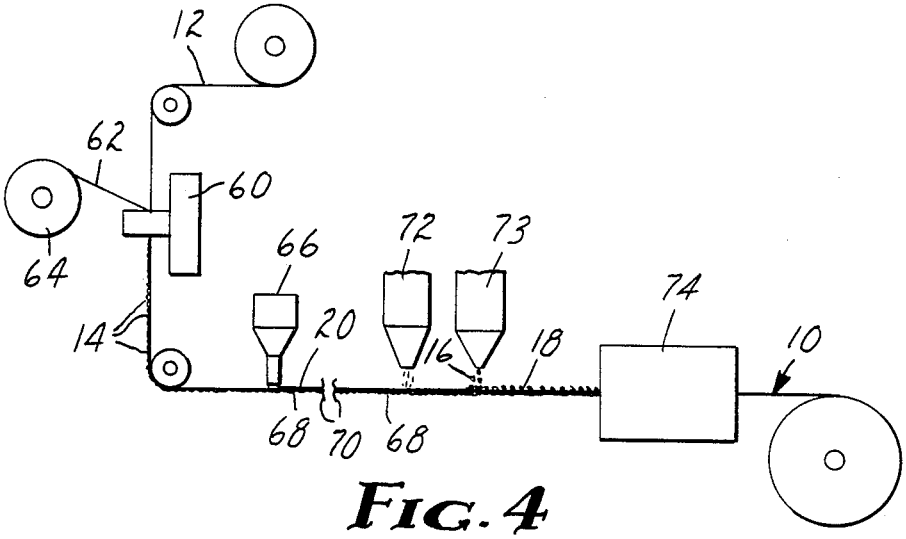
FIG. 4 is a schematic view of a production line practicing a method according to the present invention for making the coated abrasive sheet material of FIG. 1.

FIG. 4 schematically illustrates a method for forming the coated abrasive sheet material 10 of FIGS. 1 and 2 in which a length of the nonwoven carrier web 12 is fed through a machine 60 (e.g., a Malimo TM type Malipol Stitch-Knitting machine manufactured by Textima in East Germany) supplied with a multiplicity of multifilament threads 62 from a source 64. The machine 60 stitches into the carrier web 12 parallel rows of stitches which are spaced, have stitch lengths along the rows, and produce loops 14 in the pattern shown and described with reference to FIG. 1. The stitched carrier web 12 is then coated on its side opposite the loops 14 by an extender 66 to form the layer of adhesive 20 and provide a backing structure 68. Subsequently, after the backing structure 68 has been dried and slit to a desired width (which steps have not been shown, but which are schematically allowed for by the break lines 70), the backing structure 68 is coated at station 72 with make resin, electrostatically coated with abrasive grains 16 at station 73, and then further coated with size resin to complete the layer of bonding material 18 and dried at station 74 to form the finished coated abrasive material 10.

EXAMPLE

As a specific non-limiting example of the sheet material 10 of FIGS. 1 and 2, a white Confil TM wetlaid nonwoven fabric comprising a blend of cellulose and polyester fibers bonded with a polymer believed to be an acrylate adhesive, purchased as Style 1213033 White Confil wetlaid fabric from International Paper Company, was used as the carrier web 12. That carrier web 12 was stitched on a 14 gauge Malimo TM type Malipol Stitch-knitting Machine operated in its single bar mode with 3 millimeter pile sinkers to produce 14 evenly spaced rows of stitches per inch in a cross web direction and to form 12 stitches per inch along each row, and to form loops 14 projecting from the carrier web by about 1 to 2 millimeters. The thread 13 used to form the stitches was a commercial grade 150 denier, 36 filament textured polyester thread commercially purchased from O'Mara Incorporated, Devon, Pa.

The stitched carrier web was then coated on its surface opposite the loops with a 5 to 8 mil layer of the ethylene/vinyl acetate terpolymer adhesive commercially designated Elvax II 5650T by Dupont applied through a slot die extruder having a die temperature of about 400° F. to form the coating 20 of adhesive.

The adhesive coated stitched carrier web was then dried, slit to a desired width, and electrostatically coated with grade 36 abrasive granules 16 over the coating 20 of adhesive using a phenolic resin size coating and a urea formaldehyde make resin to form the bonding resin 18.

The dried abrasive coated sheet material 10 made in this test exhibited excellent adhesion between the bonding resin 18, the abrasive granules 16 and the coating 20 of adhesive and between the coating 20 of adhesive and the carrier web 12, and no internal delamination of the coated sheet material 10 was noted when discs were cut from it and used to abrade a substrate.

I claim:

1. A flexible coated abrasive sheet material comprising a layer of abrasive grains adhered in place by a layer of bonding resin and having a multiplicity of loops projecting from its side opposite the abrasive grains which sheet material is adapted to be held on the support surface of a pad from which project a multiplicity of hooks by releasable engagement between the loops and the hooks while the sheet is driven by the pad to abrade a workpiece, wherein said sheet material comprises a carrier web with a multiplicity of multifilament yarns stitched into it with portions of the yarns providing said loops, and an adhesive coating on the side of the carrier web opposite the loops to adhere the yarn to itself and to the carrier web.

2. A coated abrasive sheet material according to claim 1 wherein said carrier web is of nonwoven construction.

3. A flexible coated abrasive sheet material according to claim 2 wherein said abrasive grains are coated directly on the side of said carrier web opposite said loops over said layer of adhesive.

4. A flexible coated abrasive sheet material according to claim 1 wherein said abrasive grains are coated directly on the side of said carrier web opposite said loops over said layer of adhesive.

5. A flexible coated abrasive sheet material according to claim 1 further including a backing layer having said abrasive grains coated on one side and bonded along its side opposite said abrasive grains to the surface of said carrier web opposite said loops over said layer of adhesive.

* * * * *